US005329653A

United States Patent [19]

Hultgren

[11] Patent Number: 5,329,653

[45] Date of Patent: Jul. 19, 1994

[54] CARPET RESTRAINING STRIP

[75] Inventor: George A. Hultgren, Oquawka, Ill.

[73] Assignee: Harry Hultgren, Rockford, Ill.

[21] Appl. No.: 1,274

[22] Filed: Jan. 7, 1993

[51] Int. Cl.[5] ..... A47G 27/04
[52] U.S. Cl. ..... 16/16
[58] Field of Search ..... 16/4, 16

[56] References Cited

U.S. PATENT DOCUMENTS

| | | | |
|---|---|---|---|
| 1,770,215 | 7/1930 | McIntyre | 16/16 |
| 2,211,574 | 8/1940 | McNicholas | 16/16 |
| 2,563,615 | 8/1951 | Paul | 16/16 |
| 2,670,494 | 3/1954 | Owens | 16/16 |
| 3,559,273 | 2/1971 | Porzio | 16/16 |
| 3,805,862 | 4/1974 | Jirovetz | 16/16 |
| 3,997,937 | 12/1976 | Manguso | 16/16 |
| 4,309,805 | 1/1982 | Jacobson | 16/16 |
| 4,581,269 | 4/1986 | Tilman | 16/16 |
| 4,653,138 | 3/1987 | Carder | 16/16 |
| 4,682,925 | 7/1987 | Shields | 16/16 |
| 4,759,096 | 7/1988 | Dorris | 16/16 |
| 4,837,889 | 6/1989 | Saotome | 16/16 |

OTHER PUBLICATIONS

Fal-Kon Enterprises Flier.

*Primary Examiner*—Lowell A. Larson
*Assistant Examiner*—Donald M. Gurley
*Attorney, Agent, or Firm*—Andrus, Sceales, Starke & Sawall

[57] ABSTRACT

A carpet tack strip includes a strip member having a notch throughout its length. A series of tacks are mounted to the strip member, with the points of the tacks extending above the upper surface of the strip member. Horizontal passages extend between the sides of the strip member. The tack strip is advantageously used when laying carpet on a concrete floor. The strip is placed such that the notch faces the lower end of a wall against which the carpet is to be placed. Nails are placed through the passages and driven into the wall, to securely mount the tack strip to the wall. The carpet pad abuts the outer edge of the tack strip, and the carpet is placed over the tack strip and tucked into the notch. The tack points retain the carpet in place, and the nails prevent the tack strip from being pulled away from the wall.

9 Claims, 1 Drawing Sheet

CARPET RESTRAINING STRIP

BACKGROUND AND SUMMARY

This invention pertains to a carpet retaining device commonly known as a carpet tack strip, and more particularly to a carpet tack strip construction for use in laying carpet on a concrete floor.

A conventional carpet tack strip consists of an elongated strip of wood, typically a laminated wood product such as plywood. A series of relatively short nails or tacks are driven through the strip such that the head of each tack is flush with the underside of the strip, and the point of each tack extends above the upper surface of the strip.

When laying carpet on a wood floor, the strips are nailed, stapled or otherwise secured to the floor adjacent the edges of the room in which the carpet is being laid. The carpet pad is cut and placed such that its edge is located adjacent the outer edge of the strip, and the carpet is laid over the pad and strip and retained in place by the upwardly facing points of the tacks.

When laying carpet on a concrete floor, it is known to drill holes in the floor around the edges of the room, in locations where the tack strip is to be placed. Anchors are mounted within the holes, and threaded fasteners are employed to mount the tack strip to the anchors, for securing the strip in place on the floor. As can be appreciated, drilling a large number of holes into a concrete floor is a time consuming, cumbersome and messy procedure, thus increasing the time and expense involved in laying carpet on a concrete floor. Alternatively, concrete nails are used to secure the strip to the floor. This results in chipping of the concrete in the vicinity of each nail, resulting in inadequate holding of the strip when the carpet is stretched over the strip.

It is an object of the present invention to provide an improved carpet tack strip structure for use in laying carpet on a concrete floor or the like. It is a further object of the invention to provide a carpet tack strip structure which is easily installed over a concrete floor and which functions in a manner similar to a conventional tack strip. Yet another object of the invention is to provide such a carpet tack strip which is relatively easy and inexpensive to manufacture.

In accordance with the invention, a carpet tack strip for use in laying carpet on a concrete floor and for placement adjacent a wall, consists of an elongated notched strip member. The notch is formed at one of the edges of the strip member along the length of the strip member, and defines a vertical surface and a horizontal upwardly facing surface. The strip member is placed against the wall with the notch located immediately adjacent the wall, to define a space between the wall and the vertical surface defined by the notch. The strip member thus consists of a lower base portion extending throughout the entire width of the strip member, and an upper portion extending upwardly from the base portion and spaced from the wall, with the notch being located between the wall and the upper portion. A series of tacks extend through the base portion and the upper portion of the strip member, extending upwardly above the upper surface of the strip member. The tacks are preferably angled in a direction toward the notch. A series of lateral passages are formed in the strip member. The passages are preferably horizontal and are provided at equal spacing along the length of the strip member. The passages are formed in the strip member such that a portion of the passage opens onto the vertical notch surface, and a portion defines a channel opening onto the horizontal notch surface. The passages are adapted to receive fasteners such as nails, which are driven through the strip member and into the wall. With this arrangement, the strip is securely mounted to the wall at the corner formed by the wall and the floor, and it is unnecessary to penetrate the floor in order to securely mount the strip member in position. Once the strip member is secured in this manner, the carpet pad is cut and placed such that its edge is located adjacent the outer surface of the strip member. The carpet is then cut and placed over the pad, with the edge of the carpet being tucked into the notch formed in the strip member. The tacks function to retain the carpet in place.

The invention further contemplates a method of laying carpet on a concrete floor, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
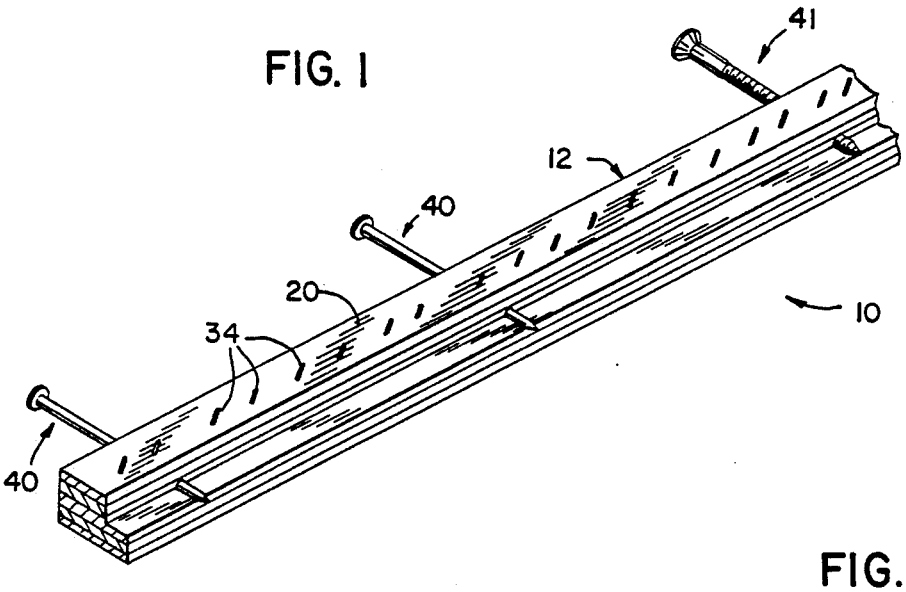
FIG. 1 is an isometric view of a carpet tack strip constructed according to the invention.
Figure 2:
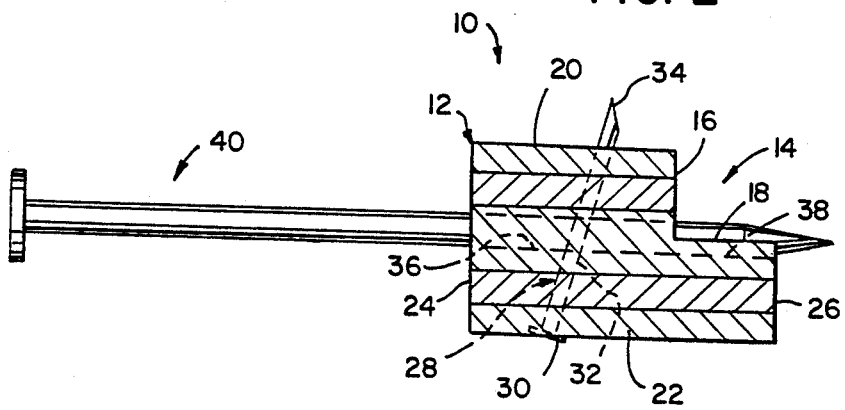
FIG. 2 is a section view of the carpet tack strip of FIG. 1.

Referring to FIGS. 1 and 2, a carpet tack strip constructed according to the invention is shown generally at 10. Tack strip 10 is generally constructed of a laminated plywood strip member 12, notched along its entire length. The notch in strip 12 is shown at 14, and defines a vertical surface 16 and a horizontal upwardly facing surface 18. Strip 12 further defines a top surface 20, a bottom surface 22, and side edges 24, 26. This construction thus provides strip 12 with a base portion lying vertically below the horizontal plane within which horizontal surface 18 lies, and an upper portion in horizontal alignment with vertical surface 16.

A series of tacks 28, each of which defines a head 30, a shank 32 and a point 34, extend through strip 12. The tack heads 30 are driven substantially flush with bottom surface 22 of strip 12, and the tack shanks 32 have a length greater than the height of strip 12, such that tack points 34 are located above top surface 20 of strip 12. Tacks 28 are angled in a direction toward notch 14 in a bottom-to-top direction, and are preferably offset from vertical approximately 15°.

Tacks 28 are located throughout the entire length of strip 12 at regular spacing, such as approximately ½".

A series of horizontal passages 36 are formed in strip 12. Passages 36 extend into strip 12 from side edge 24, and are oriented in a vertical direction so as to open partially onto vertical surface 16 defined by notch 14. An upwardly facing channel 38 is formed in horizontal surface 18 defined by notch 14, in alignment with each passage 36. Passages 36 and channels 38 are preferably formed in a single drilling operation. Passages 36 are located in spaces between tacks 28, and are spaced at approximately every 6" along the length of strip 12.

Each of passages 36 and channels 38 are adapted to receive the shank of a fastener, such as a nail 40 or a screw 41.

Figure 3:
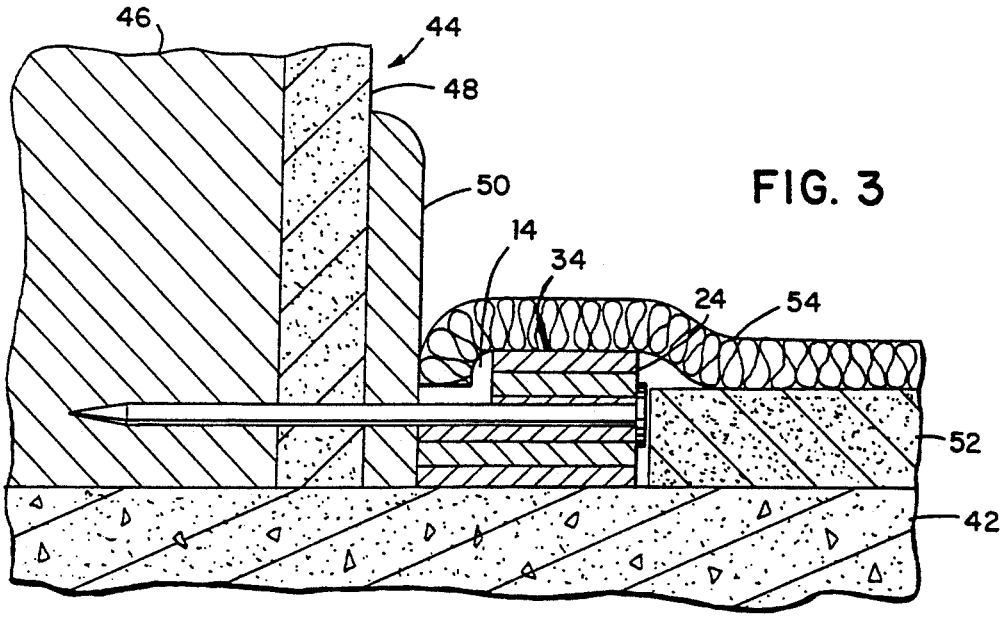
FIG. 3 is a section view showing the carpet tack strip of FIGS. 1 and 2 as installed on a concrete floor, showing placement of the strip, carpet and pad.

Carpet tack strip 10 is adapted to be installed in a manner as shown in FIG. 3. In FIG. 3, a concrete floor onto which carpet is to be laid is shown at 42. A wall 44 extends upwardly from floor 42, and in a typical construction includes a plate or stud 46 to which a sheet of wallboard 48 is mounted. A strip of trim or molding 50 is mounted at the corner defined by wallboard 48 and floor 42. This construction is conventional.

Carpet tack strip 10 is placed on floor 42 at the corner defined by molding 50 and floor 42, such that side edge 26 of tack strip 10 abuts the outwardly facing surface of molding 50. Bottom surface 22 of tack strip 10 engages the upper surface of floor 42. With tack strip 10 in this position, nails 40 or screws 41 are placed into passages 36 and are driven through molding 50 and wallboard 48 into plate or stud 46, until the head of each nail 40 or screw 41 engages side edge 24 of tack strip 10. This functions to securely mount tack strip 10 to wall 44. This is done about the entire circumference of the room to be carpeted, with tack strip 10 being cut to size as necessary.

A carpet pad 52 is then cut and placed as shown in FIG. 3, with its outer edge closely adjacent side edge 24 of tack strip 10. After pad 52 is in place, carpet 54 is cut to size, stretched, and engaged with tack points 34 of tack strip 10 in a manner as shown in FIG. 3. The edge of carpet 54 is tucked into notch 14, as shown. Nails 40 or screws 41 prevent tack strip 10 from being pulled away from wall 44 when carpet 54 is placed in this manner.

It should be appreciated that while smooth-shank nails 40 have been illustrated, any other satisfactory threaded or non-threaded fastener could be used in place of nails 40. For example, ring-shank nails could be employed to strengthen the connection of tack strip 10 to the wall.

The location of passages 36, within which nails 40 are located, prevents tack strip 10 from overturning or otherwise failing when carpet 54 is applied to tack strip 10.

The dimensions of a prototype construction of tack strip 10 are as follows. Bottom surface 22 is $\frac{3}{4}$ inches wide, and side edge 24 is $\frac{1}{2}$ inches high. Notch 14 is $\frac{1}{4}$ inches wide by $\frac{1}{4}$ inches high, which thus are the dimensions of horizontal surface 18 and vertical surface 16, respectively. The centerline of passages 36 is $\frac{1}{4}$ inches from bottom surface 22.

It should also be appreciated that, while strip 12 has been illustrated as a laminated plywood member, any other satisfactory material of construction could be employed, such as solid wood, plastic or the like.

Various alternatives and embodiments are contemplated as being within the scope of the following claims particularly pointing out and distinctly claiming the invention.

I claim:

1. A carpet tack strip for use in installing carpet on a floor, the tack strip being adapted for installation at a corner defined by the floor and a wall extending upwardly therefrom, the carpet tack strip comprising:

a unitary elongated strip member defining a top surface, a bottom surface, and a pair of side surfaces;

a plurality of tacks mounted to the strip member, each tack having a point extending above the top surface of the strip member; and an elongated notch formed in the strip member extending the length of the strip member, the notch extending downwardly from the strip member top surface, inwardly from one of the strip member side surfaces and terminating upwardly of the strip member bottom surface, wherein the strip member is placed on the floor such that the notch faces the wall and the strip member side surface from which the notch extends engages the wall; and wherein fasteners are adapted to be driven through the strip member and into the wall for mounting the strip member to the wall at the corner defined by the floor and the wall without connection to the floor, and wherein the carpet is laid over the strip and engaged with the tack points for retaining the carpet in place, wherein the edge of the carpet is tucked into the notch adjacent the wall.

2. The carpet tack strip of claim 1, wherein the notch extends downwardly from the top surface of the strip member approximately half the thickness of the strip member.

3. The carpet tack strip of claim 2, wherein the strip member comprises a base portion below the notch and an upper portion extending upwardly from the base portion in horizontal alignment with the notch.

4. The carpet tack strip of claim 3, wherein the strip member comprises a strip of laminated wood material.

5. The carpet tack strip of claim 1, further comprising a plurality of spaced lateral passages extending through the strip member, the passages extending inwardly from the other side surface of the strip member and opening toward the notch.

6. The carpet tack strip of claim 5, wherein the passages are vertically located so as to open into the notch.

7. A carpet tack strip for use in installing carpet on a floor, the tack strip being adapted for installation at a corner defined by the floor and a wall extending upwardly therefrom, the carpet tack strip comprising:

an elongated strip member defining a top surface, a bottom surface, and a pair of side surfaces;

a plurality of tacks mounted to the strip member, each tack having a point extending above the upper surface of the strip member;

a notch formed in the strip member, the notch extending inwardly from one of the side surfaces and downwardly from the top surface approximately half the thickness of the strip member, wherein the strip member comprises a base portion below the notch and an upper portion extending upwardly from the base portion in horizontal alignment with the notch, and wherein the strip member is placed on the floor such that the notch faces the wall; and a plurality of spaced lateral passages extending through the strip member, the passages extending inwardly from the side surface of the strip member opposite the notch and opening toward the wall, wherein the passages are vertically located so as to open into the notch;

wherein the notch defines a vertical surface and a horizontal surface, wherein each passage opens partially onto the vertical surface and partially onto the horizontal surface to define an upwardly facing channel therein; and wherein fasteners are adapted to be placed through the passages and into the wall for mounting the strip member to the wall at the corner defined by the floor and the wall without connection to the floor, and wherein the carpet is laid over the strip and engaged with the tack points for retaining the carpet in place, wherein the edge of the carpet is tucked into the notch adjacent the wall.

8. A carpet tack strip for use in installing carpet on a floor, the carpet tack strip being adapted for placement at a corner defined by the floor and a wall extending upwardly therefrom, comprising:

a unitary elongated strip member defining a base portion including a bottom surface for placement on the floor and first and second side surfaces extending upwardly from the bottom surface;

an upper portion extending upwardly from the base portion and defining a top surface and first and second side surfaces extending downwardly from the top surface, wherein at least a first one of the upper portion side surfaces is laterally offset from a first one of the base portion side surfaces, and wherein the base portion defines a laterally extending upwardly facing surface extending therebetween the length of the strip member;

a plurality of tacks mounted to the strip member, each tack having a point extending above the top surface defined by the strip member upper portion; and wherein the strip member is placed on the floor in engagement with the wall such that the first side surface of the strip member base portion from which the lateral surface extends is engaged with the wall, and wherein fasteners are adapted to be driven through the strip member and into the wall for mounting the strip member to the wall without connection to the floor, wherein carpet is laid over the strip and engaged with the tack points for retaining the carpet in place, and wherein the edge of the carpet extends over the strip member upper portion and is tucked downwardly toward the lateral surface defined by the strip member base portion adjacent the wall.

9. A method of installing carpet adjacent a wall extending upwardly from a floor, comprising the steps of:

providing a unitary elongated carpet tack strip defining a top surface, a bottom surface and a pair of side surfaces, the strip having a notch formed therein extending downwardly from the top surface and inwardly from one of the side surfaces, the carpet tack strip further including a plurality of tacks each having a point extending above the top surface of the carpet tack strip;

placing the carpet tack strip on the floor adjacent the wall such that the side surface of the carpet tack strip from which the notch extends inwardly is engaged with the wall throughout substantially the entire length of the strip;

installing the carpet tack strip by laterally driving a fastener through the carpet tack strip and into the wall for mounting the carpet tack strip to the wall without connection to the floor;

placing carpet over the carpet tack strip and engaging the carpet with the tack points; and tucking the edge of the carpet into the notch adjacent the wall.

* * * * *